US010464310B2

(12) United States Patent
Kameshima et al.

(10) Patent No.: US 10,464,310 B2
(45) Date of Patent: Nov. 5, 2019

(54) RECORDING APPARATUS AND RECORDING METHOD

(71) Applicant: CANON KABUSHIKI KAISHA, Tokyo (JP)

(72) Inventors: Rinako Kameshima, Tachikawa (JP); Minoru Teshigawara, Saitama (JP); Yoshiaki Murayama, Tokyo (JP); Masaki Nitta, Yokohama (JP); Eisuke Nishitani, Tokyo (JP); Keiichirou Takeuchi, Komae (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/005,521

(22) Filed: Jun. 11, 2018

(65) Prior Publication Data

US 2018/0361731 A1 Dec. 20, 2018

(30) Foreign Application Priority Data

Jun. 15, 2017 (JP) ..... 2017-117891

(51) Int. Cl.

| | |
|---|---|
| ***B41M 5/00*** | (2006.01) |
| ***B41J 2/005*** | (2006.01) |
| ***B41J 2/21*** | (2006.01) |
| ***B41M 5/025*** | (2006.01) |
| *B41J 25/00* | (2006.01) |
| *B41M 5/03* | (2006.01) |
| *B41M 7/00* | (2006.01) |

(52) U.S. Cl.

CPC ..... *B41J 2/0057* (2013.01); *B41J 2/2114* (2013.01); *B41J 2/2146* (2013.01); *B41M 5/0256* (2013.01); *B41J 2025/008* (2013.01); *B41M 5/0011* (2013.01); *B41M 5/03* (2013.01); *B41M 7/0018* (2013.01)

(58) Field of Classification Search

CPC ..... B41J 2/0057; B41J 2/2114; B41J 2/2146; B41J 2025/008; B41M 5/0256; B41M 7/0018; B41M 5/03; B41M 5/0011

See application file for complete search history.

(56) References Cited

U.S. PATENT DOCUMENTS

2007/0064077 A1* 3/2007 Konno ..... B41J 2/0057 347/102
2009/0085960 A1* 4/2009 Yahiro ..... B41J 2/2114 347/21
2011/0310140 A1* 12/2011 Tonohiro ..... B41J 11/0015 347/6

FOREIGN PATENT DOCUMENTS

JP 2007-276400 A 10/2007
JP 2010-082492 A 4/2010

* cited by examiner

*Primary Examiner* — Yaovi M Ameh

(74) *Attorney, Agent, or Firm* — Canon USA, Inc., IP Division

(57) ABSTRACT

A recording apparatus includes an ink application unit configured to apply ink to a transfer body, a first application unit configured to apply a first treatment liquid over an area on the transfer body, a second application unit configured to apply a second treatment liquid to the transfer body, a heating unit configured to heat the second treatment liquid applied to the transfer body, and a transfer unit configured to transfer the ink image, wherein a ratio of the second treatment liquid to the first treatment liquid on an outside of ink portion is determined according to the recording medium.

14 Claims, 11 Drawing Sheets

FIG.7A

| R | G | B | | C1 | M1 | Y1 | K1 | Post1 |
|---|---|---|---|---|---|---|---|---|
| 0 | 0 | 0 | | 0 | 0 | 0 | 4096 | 128 |
| 0 | 0 | 32 | | 128 | 0 | 0 | 4000 | 128 |
| 0 | 0 | 64 | | 256 | 0 | 0 | 3800 | 128 |
| ⋮ | | | | | | | | |
| 0 | 0 | 128 | | 2048 | 2048 | 0 | 0 | 128 |
| ⋮ | | | | | | | | |
| 0 | 128 | 0 | | 2048 | 0 | 2048 | 0 | 128 |
| ⋮ | | | | | | | | |
| 255 | 255 | 255 | | 0 | 0 | 0 | 0 | 128 |

FIG.7B

| R | G | B | | C1 | M1 | Y1 | K1 | Post1 |
|---|---|---|---|---|---|---|---|---|
| 0 | 0 | 0 | | 0 | 0 | 0 | 4096 | 128 |
| 0 | 0 | 32 | | 128 | 0 | 0 | 4000 | 128 |
| 0 | 0 | 64 | | 256 | 0 | 0 | 3800 | 128 |
| ⋮ | | | | | | | | |
| 0 | 0 | 128 | | 2048 | 2048 | 0 | 0 | 128 |
| ⋮ | | | | | | | | |
| 0 | 128 | 0 | | 2048 | 0 | 2048 | 0 | 128 |
| ⋮ | | | | | | | | |
| 255 | 255 | 255 | | 0 | 0 | 0 | 0 | 0 |

RECORDING APPARATUS AND RECORDING METHOD

BACKGROUND OF THE INVENTION

Field of the Invention

The present disclosure relates to a recording apparatus and a recording method.

Description of the Related Art

An ink jet recording apparatus is conventionally known as an apparatus that ejects a liquid such as ink onto a recording medium such as paper to record an image. An inkjet recording apparatus of recent years employs a method for applying a pre-treatment liquid which reacts with ink to a recording medium in advance in order to realize a high-quality text and a high definition image by suppressing ink bleeding. In this method, aggregation of a color material contained in ink is prompted on a recording medium by applying a pre-treatment liquid that insolubilizes or aggregates the color material contained in the ink and by ejecting ink droplets containing the color material from an ejection head onto the recording medium. In such a manner, ink bleeding can be suppressed, and thus high-quality characters and high-definition images can be realized. As a method for applying a pre-treatment liquid, Japanese Patent Application Laid-Open No. 2010-82492 discusses a method using an application roller and a method for ejecting a pre-treatment liquid onto recording paper using an ejection head similarly to a method for ink ejection.

In the method for ejecting a pre-treatment liquid using the ejection head, a pre-treatment liquid can be disposed on or near a position where ink droplets are ejected. In order to securely aggregate a color material contained in ink, a pre-treatment liquid is necessarily ejected in advance onto a position on a recording medium where ink droplets are ejected. For this reason, the pre-treatment liquid is necessarily ejected to a position wider than the ink droplet ejection position in consideration of a misalignment error of the ink droplet ejection position. In order to eject a pre-treatment liquid to a wide range, Japanese Patent Application Laid-Open No. 2007-276400 discusses a method for executing expansion processing on ejection data of ink droplets and ejecting a pre-treatment liquid based on obtained ejection data of the pre-treatment liquid.

However, the pre-treatment liquid is not sufficiently permeated into a certain type of recording medium or an unreacted treatment liquid is not fixed to a portion on a medium surface where an ink application amount is small. Therefore, that portion of the medium surface is exposed. In a case where a user holds the recording medium on which an image is formed in this state, if the pre-treatment liquid in an insufficiently fixed state is touched by a finger, the treatment liquid might be peeled, and thus quality of a printed object is deteriorated.

SUMMARY OF THE INVENTION

The present disclosure is directed to obtaining a printed object, a texture of which quality is difficult to deteriorate, by using a pre-treatment liquid.

According to an aspect of the present disclosure, a recording apparatus includes an ink application unit configured to apply ink to a transfer body to form an ink image corresponding to an image to be formed on the transfer body, a first application unit configured to apply a first treatment liquid over an area from a portion on the transfer body to which the ink is applied to an outside of the ink applied portion, the first treatment liquid containing a component which acts on a component included in the ink and suppressing a movement of the ink on the transfer body through the action, a second application unit configured to apply a second treatment liquid to the transfer body, the second treatment liquid including a resin which becomes a membrane by heating, a heating unit configured to heat the clear second treatment liquid applied to the transfer body, and a transfer unit configured to transfer the ink image, the first treatment liquid outside the ink image, and the second treatment liquid onto a recording medium. In a case where the recording medium is a predetermined medium, the second application unit applies the second treatment liquid to the first treatment liquid on the outside of the ink applied portion in a predetermined ratio, and in a case where permeability of the first treatment liquid is higher in the recording medium than in the predetermined medium, the second application unit applies the second treatment liquid to the first treatment liquid on the outside portion in a ratio lower than the predetermined ratio or does not apply the second treatment liquid.

Further features of the present disclosure will become apparent from the following description of exemplary embodiments with reference to the attached drawings.

BRIEF DESCRIPTION OF THE DRAWINGS

FIGS. 7A and 7B are diagrams illustrating examples of a 3-dimensional lookup table (3-D LUT) according to the exemplary embodiment.

DESCRIPTION OF THE EMBODIMENTS

Exemplary embodiments of the present disclosure will be described below with reference to the drawings.

Figure 1:
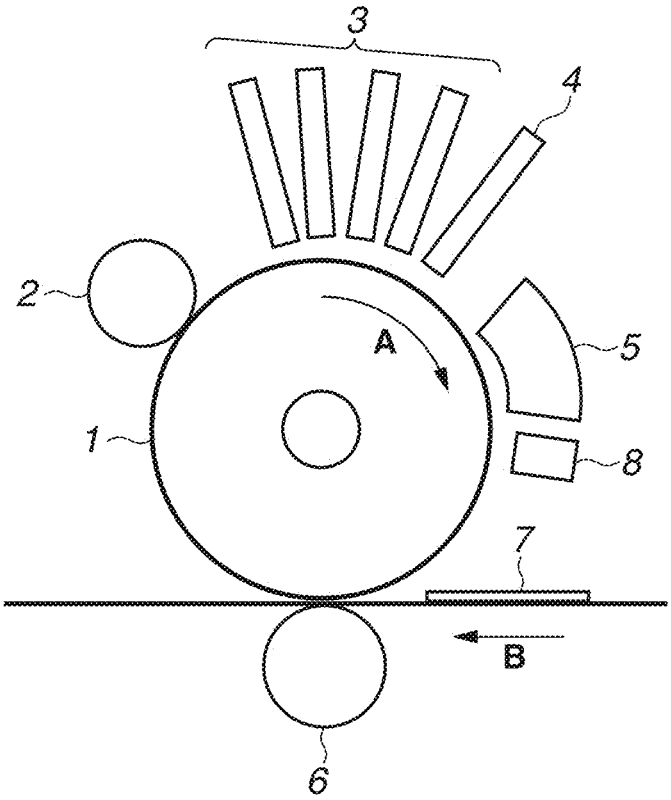
FIG. 1 is a cross-sectional view of an ink jet recording apparatus according to an exemplary embodiment.

A first exemplary embodiment will be described below. FIG. 1 is a cross-sectional view illustrating a configuration of an image forming unit of an ink jet recording apparatus according to a first exemplary embodiment.

An application roller is configured to apply a pre-treatment liquid in a pre-treatment liquid application unit 2 to an intermediate transfer body of a transfer drum 1. The transfer drum 1 rotates around its center serving as a rotation axis in a direction of an arrow A. The pre-treatment liquid is applied to an entire image-forming area of the intermediate transfer body by the application roller. The intermediate transfer body has a drum shape but may have a belt shape or a plate shape. The intermediate transfer body has a surface made of a compound containing fluorine or silicone. The application roller is longer than the intermediate transfer body in a length in an extending direction of the rotary shaft of the transfer drum 1 (direction that passes through a cross section as illustrated). Although the application roller is used in the present case, an application method is not particularly limited as long as the pre-treatment liquid (first treatment liquid) can be applied to an entire area where ink of the intermediate transfer body can be applied. After the application of the liquid, ink is ejected from each head of a recording head unit 3, and an ink image is formed on the intermediate transfer body based on data. A post-treatment liquid application unit 4 applies a post-treatment liquid (second treatment liquid) to the formed ink image. In the present exemplary embodiment, the post-treatment liquid is ejected from a plurality of nozzles disposed in the extending direction of the rotary shaft of the transfer drum 1 by a post-treatment liquid ejection head that ejects the post-treatment liquid according to an ink jet method. The pre-treatment liquid may be applied after the ink is ejected. In this case, the pre-treatment liquid may be applied to the entire area not by the roller but by the ink jet method in a similar manner. The recording head unit 3 includes four-color recording heads for black (K), cyan (C), magenta (M), and yellow (Y). However, a number of colors is not limited to four. The fixed recording heads includes the nozzles that eject the ink to the entire recording area in the extending direction of the rotary shaft of the transfer drum 1. The recording head unit may also employ recording heads that perform recording while a carriage performs scanning in a direction orthogonal to a conveyance direction of a recording medium.

Next, a liquid absorption unit 5 executes liquid absorption processing for absorbing moisture from the ink image to which the post-treatment liquid has been applied. A heating unit 8 heats the ink image which has been subject to the liquid absorption processing to melt particles in the post-treatment liquid and produce a membrane. This results in improvement of a transfer property of the ink image from the intermediate transfer body to a recording medium 7 and fixability of the ink image to the recording medium 7. Then, the ink image on the intermediate transfer body is transferred to the recording medium 7. During the transfer, a pressure is applied in a direction of the transfer drum by a pressure cylinder 6 to the recording medium 7 to be conveyed in a direction of arrow B by a conveyance belt.

Figure 2:
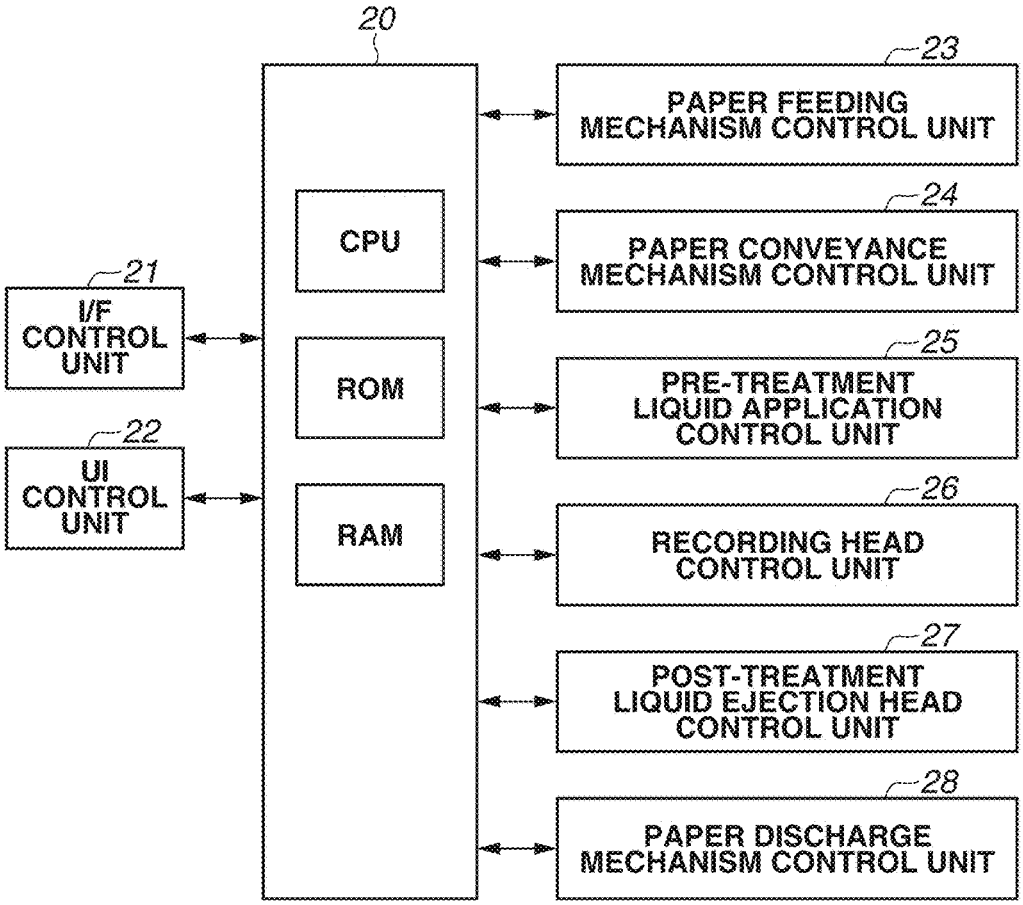
FIG. 2 is a block diagram illustrating a control system of the ink jet recording apparatus according to the present exemplary embodiment.

FIG. 2 is a block diagram illustrating a concept of the control system of the ink jet recording apparatus according to the present exemplary embodiment. A system control unit 20 includes a central processing unit (CPU), a read-only memory (ROM), and a random-access memory (RAM) to control the entire recording apparatus in an integrated manner. Besides, the same CPU, the ROM, and the RAM for controlling the recording apparatus in the integrated manner, or another type of CPU, ROM, and RAM are used to execute image data processing for an image to be recorded, which has been received from an external apparatus, and to transmit the processed data to a recording head control unit 26 and a post-treatment liquid ejection head control unit 27. An interface control unit 21 controls communication to exchange image data and a recording command with an external apparatus or a media in which image data representing a recorded image is stored. A user interface control unit 22 displays a menu, a setting screen, and a state of the recording apparatus to perform control to receive an operation from a user. An input type of a recording medium can be reflected in control of recording corresponding to permeability of the recording medium. A paper feeding mechanism control unit 23, a medium conveyance mechanism control unit 24, and a paper discharge mechanism control unit 28 control a paper feeding roller, a medium conveyance belt, and a paper discharge roller (not illustrated), based on instructions from the system control unit 20. Thus, a recording medium is fed, is conveyed to a transfer unit including the pressure cylinder 6, and is discharged from the recording apparatus. The recording head control unit 26 controls the recording head unit 3 based on an instruction from the system control unit 20 such that an ink image is formed on the conveyed recording medium, based on the image data received by the interface control unit 21. A pre-treatment liquid application control unit 25 controls the pre-treatment liquid application unit 2 based on an instruction from the system control unit 20 such that the pre-treatment liquid is applied to the recording medium. The post-treatment liquid ejection head control unit 27 controls the post-treatment liquid ejection head of the post-treatment liquid application unit 4 based on an instruction from the system control unit 20 so that the post-treatment liquid is ejected to the recording medium.

In present exemplary embodiment, the recording apparatus using the intermediate transfer body is described. However, ink ejected from the recording head unit may be applied directly to a recording medium, bypassing the intermediate transfer body.

Figure 3:
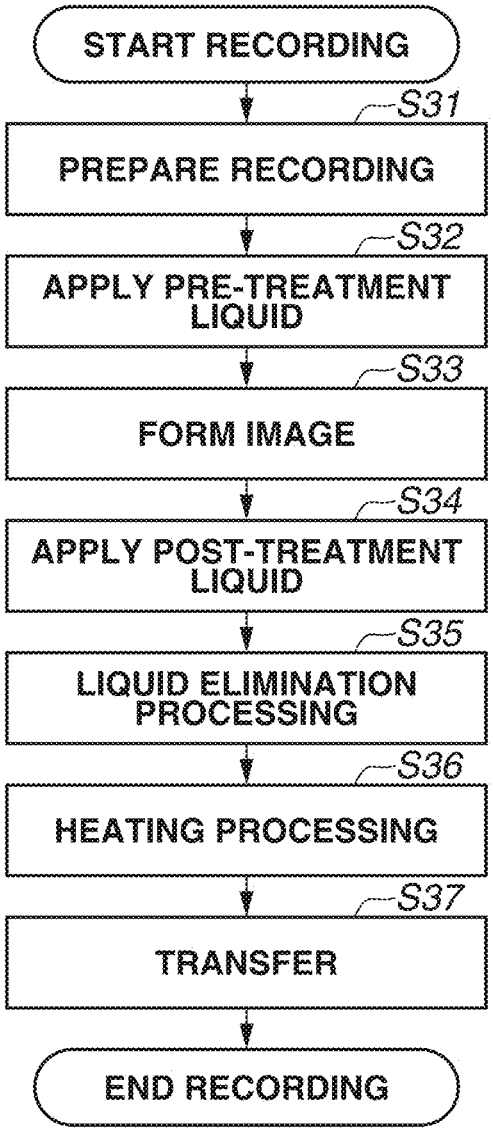
FIG. 3 is a flowchart of a recording process according to the exemplary embodiment.

FIG. 3 illustrates a flowchart of the recording processing of the ink jet recording apparatus in FIG. 1. Each step S31 to S36 will be described below.

In step S31, the system control unit 20 prepares for recording by creating recording data and transmitting the recording data to a corresponding head. Detailed contents will be described below with reference to FIG. 4.

In step S32, the system control unit 20 instructs the pre-treatment liquid application control unit 25 such that the pre-treatment liquid application unit 2 applies a pre-treatment liquid to the intermediate transfer body on the transfer drum 1. The pre-treatment liquid suppresses transfer of ink droplets applied onto the intermediate transfer body and maintains a position of the ink droplets. The pre-treatment liquid includes organic acid that reduces fluidity of color ink containing a coloring material to insolubilize and aggregate the color material and a resin in the ink. Herein, a pre-treatment liquid containing glutaric acid, a solvent, and an activator is used. However, a pre-treatment liquid containing organic acid such as citric acid, malic acid, and malonic acid may also be used. The suppression of the movement of ink droplets caused by the action of the pre-treatment liquid means that a colorant and a resin that are partial composition of ink, chemically react with each other or physically adsorb to each other and thus deterioration of fluidity of the entire ink occurs. Further, the suppression includes a case where the fluidity is locally deteriorated due to aggregation of a solid content of the composition of the ink. This action can prevent movement of the ink applied onto an intermediate transfer body that hardly absorbs or does not absorb water. In order to obtain such an effect, it is preferable to apply a pre-treatment liquid over a portion on the intermediate transfer body to which ink is applied and the outside of the ink applied portion. In the present exemplary embodiment, the pre-treatment liquid is applied over an entire area on the intermediate transfer body to which an ink image is to be formed.

Then, in step S33, based on an instruction from the system control unit 20 to the recording head control unit 26, pigment ink of each color is ejected from the recording head unit 3 to the area on the intermediate transfer body to which the pre-treatment liquid has been applied to form an ink image. The ink of each color to be ejected from each of the recording heads of the recording head unit 3 contains at least a color material, a resin, a solvent and an activator. The color material and the resin have a property of aggregating which is caused by the action of the pre-treatment liquid. As the aggregation action, an aggregation by acid-based reaction or an aggregation by metallic salt or anion-cation reaction may also be used. Each color ink may be pigment ink or dye ink.

In step S34, a post-treatment liquid for improving a transfer property and fixability of an ink image is applied to the recording medium 7, based on an instruction from the system control unit 20 to the recording head control unit 26. The post-treatment liquid improves fixability of the ink image and the pre-treatment liquid on the recording medium 7 which is a transfer destination of the ink image. In order to improve the fixability of the ink image and the pre-treatment liquid on the recording medium 7, it is effective that an ink image formed portion on the recording medium 7 and an ink image not formed portion where the pre-treatment liquid has been applied contain a lot of resin which contributes to adherence to the recording medium 7. The post-treatment liquid which contains the resin is applied to the ink and the pre-treatment liquid applied onto the transfer drum 1, and thus a resin component on the portion to which the post-treatment liquid has been applied is increased. By transferring the pre-treatment liquid and the ink image in such a state, a resin content can be increased on the ink image formed portion on the recording medium 7 and the portion of the pre-treatment liquid. Further, when the post-treatment liquid is applied onto the formed ink image, if the post-treatment liquid supplements the adherence between the ink image and the recording medium 7 during the transfer, it is advantageous also from a point of the transfer property.

The post-treatment liquid may include a water-soluble resin as a resin for improving the fixability on the recording medium 7 and a water-soluble crosslinking agent. In a case where a unit that applies the post-treatment liquid is a recording head that ejects the post-treatment liquid from the nozzle, it is preferable that a weight average molecular weight is within a range between 1,000 and 30,000, and more preferably a range between 3,000 and 15,000. Specific examples of such a water-soluble resin are styrene, styrene derivative, vinylnaphthalene, vinylnaphthalene derivative, and aliphatic alcohol ester of α,β-ethylenicallly unsaturated carboxylic acid. Further, a specific example is block copolymer, random copolymer, or graft copolymer including at least two monomers (at least one of them is hydrophilic polymerizable monomer) selected from acrylic acid, acrylic acid derivative, maleic acid, maleic acid derivative, itaconic acid, itaconic acid derivative, fumaric acid, fumaric acid derivative, vinyl acetate, vinyl alcohol, vinyl pyrolidone, acrylamide, and acrylamide derivative, or their salt. Alternatively, natural resins such as rosin, shellac, and starch can be preferably used. These resins are soluble with a water solution in which a base is dissolved, and are an alkali soluble resin. A post-treatment liquid 21 preferably contains the soluble resin from 0.1 to 20 weight percent with respect to an entire quantity of the post-treatment liquid 21, and more preferably from 0.1 to 10 weight percent.

In the present exemplary embodiment, a main component of the post-treatment liquid is a component excluding a pigment, which is a pigment ink colorant component ejected from the recording head unit 3.

In step S35, under control of the system control unit 20, the liquid absorption unit 5 executes liquid elimination processing for eliminating moisture from the ink image on the intermediate transfer body. In this processing, for example, a porous body is used to absorb moisture in such a manner that moisture of the pre-treatment liquid, ink and the post-treatment liquid on the intermediate transfer body is reduced.

In step S36, a heating device 8 heats the surface of the intermediate transfer body under control of the system control unit 20. As a result, the ink image on the intermediate transfer body and the post-treatment liquid applied to the pre-treatment liquid are heated, and thus a resin component in the post-treatment liquid becomes a membrane.

In step S37, the ink image as well as the post-treatment liquid which has been heated is transferred to the recording medium 7. The pressure cylinder 6 presses the recording medium 7 and the transfer drum 1 under control of the system control unit 20, and also a portion of only the pre-treatment liquid (portion where an ink image is not formed) is transferred to the recording medium 7 together with the post-treatment liquid, which has been heated.

Figure 4:
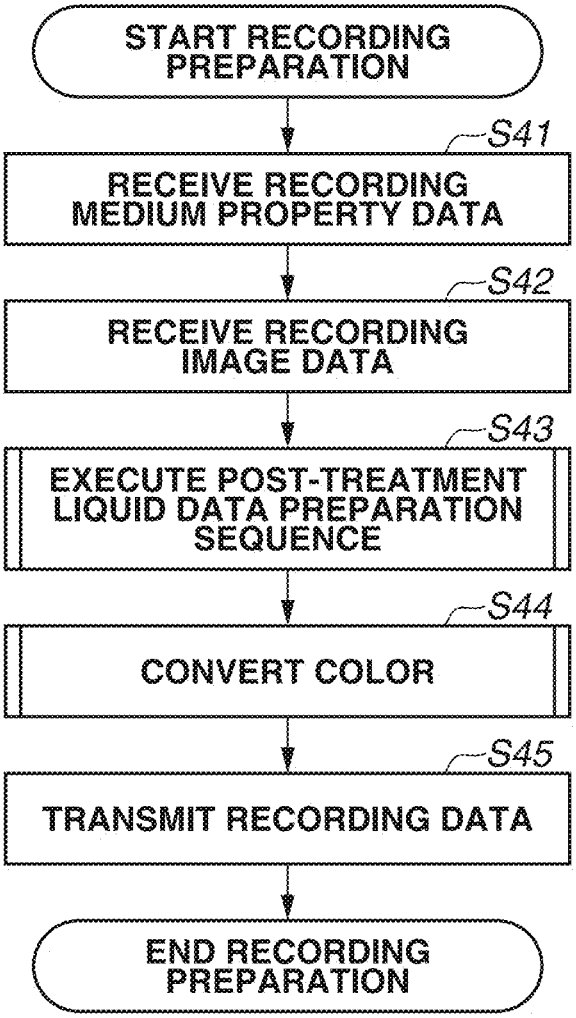
FIG. 4 is a flowchart of a part of the recording process according to the exemplary embodiment.

FIG. 4 illustrates a flowchart of recording preparation in step S31 in FIG. 3 to be executed in the system control unit 20. The ink jet recording apparatus receives recording medium property data (step S41) from an external apparatus via the interface control unit 21. This data is information about permeability of the pre-treatment liquid into a recording medium. The data may be information obtained by, for example, converting permeability into numbers, or information representing a type of recording medium. The ink jet recording apparatus receives recording image data (step S42). The system control unit 20 executes a sequence for preparing a post-treatment liquid data (step S43), and prepares for creation of the post-treatment liquid data in accordance with the permeability of the recording medium. The system control unit 20 performs color conversion in step S44 to convert signal data of ink color other than CMYK such as red, green, blue (RGB) data indicating an image with a signal of ink color into signal data of a with. Finally, in step S45, the system control unit 20 transmits to corresponding heads of the recording head unit 3 the color ink data obtained by the color conversion in step S45 and post-treatment liquid data which has been created by the color conversion in step S44 via the post-treatment liquid data preparation sequence in step S43.

Figure 5:
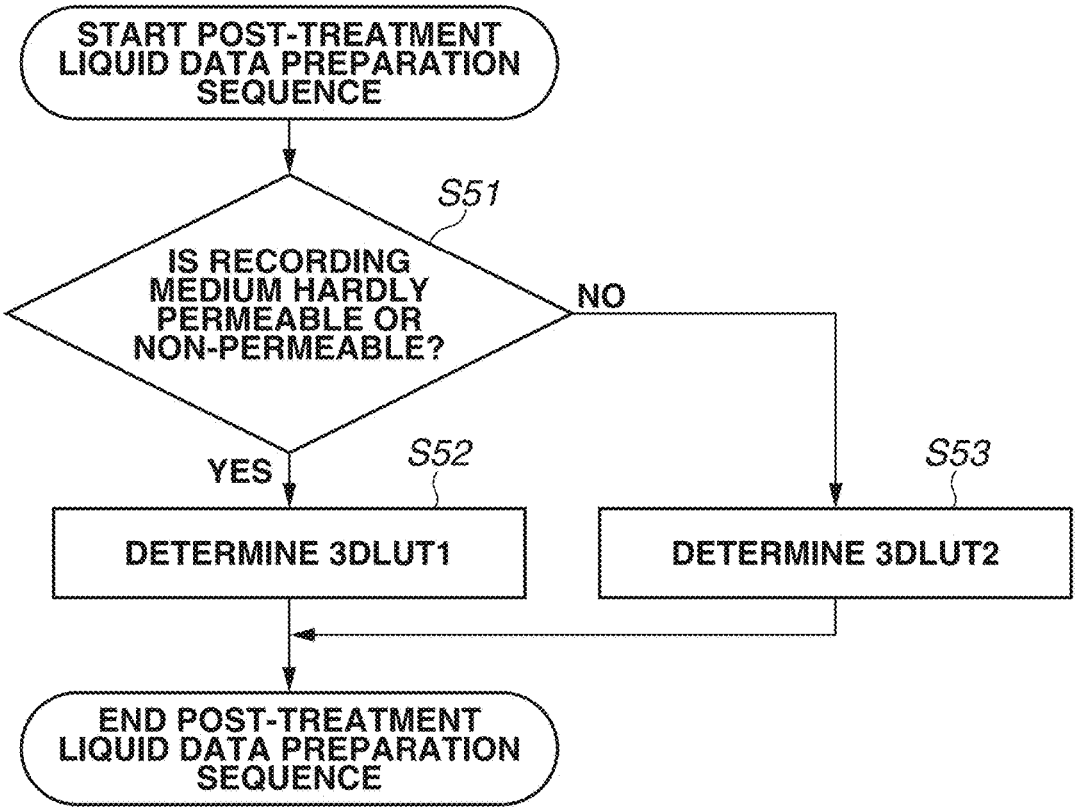
FIG. 5 is a flowchart of a part of the recording process according to the exemplary embodiment.

Details of the post-treatment liquid data preparation sequence in step S43 in FIG. 4 will be described below with reference to FIG. 5. FIG. 5 is a flowchart illustrating each step in the post-treatment liquid data preparation sequence. Each processing is executed in the system control unit 20.

At first in step S51, a parameter of the post-treatment liquid data according to permeability of a reactant with respect to a recording medium is determined by using the recording medium property data obtained in step S41. If the recording medium property data is a numerical value indicating the permeability of the reactant, predetermined permeability is set as a threshold. If the numerical value is the threshold value or more, the processing proceeds to step S52, as described below, and if the numerical value is less than the threshold value, the processing may proceed to step S53, as described below. Further, if the recording medium property data is data corresponding to a type of recording medium, a correspondence between types of recording media and parameters to be selected is stored in the ROM in advance, and a parameter may be determined in accordance with the definition. A hardly permeable or non-permeable medium can be suitably determined by taking into account compatibility between a component of a used reactant and a medium and making an examination.

In a case where a recording medium is hardly permeable or non-permeable for a reactant, fixability and a transfer property of an image to be formed by color ink must be improved, and also fixability of the pre-treatment liquid applied to the entire surface of the recording medium need to be improved. Therefore, in order to apply the post-treatment liquid also to the treatment liquid on a portion to which color ink is not applied, three-dimensional look-up table 1 (3DLUT1) is determined as parameters so that the post-treatment liquid is applied also to the portion to which color ink is not applied (step S52). Examples of the recording medium which is hardly permeable or non-permeable for a reactant are cast-coated paper, gloss coated paper, and vapor deposition paper. Application amounts of the post-treatment liquid to the portion to which color ink is applied and the area to which color ink is not applied, may be suitably determined in consideration of color ink to be applied to a recording medium to be used, transferability and fixability on a reactant, a material property of the post-treatment liquid, and a transfer condition.

Further, in step S51, if it is determined that the recording medium is not hardly-permeable or non-permeable for a reactant (No in step S51), the fixability and the transfer property need to be improved only with respect to an image to be formed by color ink. In the present exemplary embodiment, examples of the recording medium which is not hardly-permeable or non-permeable for a reactant are plain paper and gloss paper. In this case, since the reactant is absorbed by the recording medium, even if the recording medium is touched by a user's finger, it is less likely that the reactant is peeled. A rate at which the post-treatment liquid is applied to the pre-treatment liquid outside an ink application area is made lower compared with a rate in a case of the recording medium which is hardly permeable or non-permeable. 3DLUT2 as a parameter is determined such that the post-treatment liquid is applied to a portion on the intermediate transfer body to which color ink is applied, and the post-treatment liquid is not applied to a portion to which color ink is not applied (step S53). Then, the post-treatment liquid data preparation sequence is ended.

Figure 6:
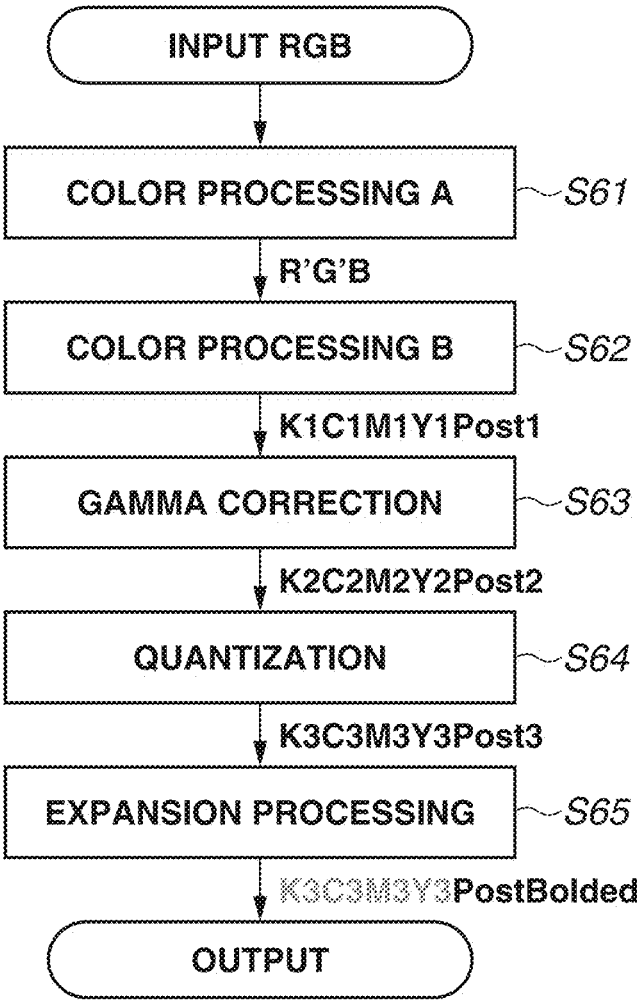
FIG. 6 is a flowchart of a part of the recording process according to the exemplary embodiment.

Color conversion in step S44 in FIG. 4 will be described below with reference to FIG. 6. FIG. 6 is a flowchart of the color conversion processing and describes steps S61 to S65. The processing is also executed in the system control unit 20.

In step S42, RGB image data indicating an original image obtained by an image input device such as a digital camera or a scanner, or through computer processing is converted into an R'G'B' signal in color processing A (step S61). In the present exemplary embodiment, input resolution of RGB multivalued image data is 600 dpi×600 dpi, and this image data is luminance data (R, G, B) in which one pixel is expressed by 8 bit and 256 level gradation. The color processing A is processing for converting a signal value of RGB corresponding to each standard color space such as sRGB or Adobe RGB which is different from a color reproduction range of the ink jet recording apparatus according to the exemplary embodiment, into each signal value of R'G'B'. The signal value of R'G'B' is adaptable to the color reproduction range of the ink jet recording apparatus according to the exemplary embodiment.

In step S62, the obtained R'G'B' signals are converted into signals corresponding to respective color inks through color processing B. In this case, the conversion is performed into data in which one pixel with 600 dpi×600 dpi resolution for each ink color is expressed by 12 bit and 4096 level gradation. Since the ink jet recording apparatus according to the present exemplary embodiment has a four-color configuration, signals of the converted data are density signals C1, M1, Y1, and K1 corresponding to cyan, magenta, yellow and black, respectively. A signal Post1 of a post-treatment liquid is also generated in combination. Accordingly, in a case where a number of ink colors is increased or decreased, a number of types of density signals may be determined according to the number of the ink colors. Specifically, in the color processing B, a three-dimensional look-up table (3DLUT) for R, G, B inputs and C, M, Y, K, and Post1 outputs are used. As for an input value away from a grid point, the input value is obtained through interpolation of output values of surrounding grid points.

One example of the 3DLUT is illustrated in FIGS. 7A and 7B. In both FIGS. 7A and 7B, respective signal values C1, M1, Y1, K1, and POST1 are determined for each RGB signal value. If ink is applied (if at least one of the values C1, M1, Y1, and K1 is not 0), the value Post1 is uniformly 128. However, if the color ink includes a fixability improvement component, the post-treatment liquid does not have to be applied onto the ink image in some cases. For example, the post-treatment liquid may not be applied to a portion where a total application amount of the inks is larger than a predetermined amount, and the post-treatment liquid may be applied to a portion where the total application amount is less than the predetermined amount. The value Post1 may be varied depending on the ink application amount in accordance with the density signal of the color ink so that a necessary amount of the post-treatment liquid is varied.

Back to the post-treatment liquid data preparation sequence described with reference to FIG. 5, one example of the 3DLUT1 to be selected in step S52 is 3DLUT illustrated in FIG. 7A. More specifically, the 3DLUT is such that even if R=G=B=255 and ink is not applied (the values C1, M1, Y1, and K1 are 0), the signal value Post1 is larger than 0 and data is generated so that the post-treatment liquid is applied.

On the other hand, one example of the 3DLUT1 selected in step S53 is the 3DLUT in FIG. 7B. More specifically, the 3DLUT is such that if R=G=B=255 and ink is not applied (C1, M1, Y1, and K1 are 0), the signal value Post1 is also 0, and data is generated so that the post-treatment liquid is not applied. Description of data in a direction in which the color becomes brighter from (R, G, B) (0, 128, 0) is omitted, but if any one of the signal values of the color ink is not 0, Post1 becomes 128. If the pre-treatment liquid has high permeability, the application of the post-treatment liquid to a portion to which ink has not been applied is prevented, and thus the post-treatment liquid can be saved.

In the above description, data of the post-treatment liquid is generated in the color conversion using 3DLUT, but the data generating method is not limited to this. In another method, for example, a logical sum of the density signal values of CMYK is taken for each pixel, and the signal Post1 may be generated so that the post-treatment liquid is applied to a portion to which at least one ink is applied. Further, the signal Post1 may be determined such that with respect to the data, if a recording medium is hardly permeable or non-permeable, the post-treatment liquid is applied to an area to which color ink is not applied, and if a recording medium is neither hardly-permeable nor non-permeable, the post-treatment liquid is not applied to an area where color ink is not applied.

Next, in step S63, the density signals C1, M1, Y1, K1, and Post1 are gamma-corrected using a correction table, and thus linearity of output signals with respect to input signals is raised, so that data including corrected signals C2, M2, Y2, K2, and Post2 is obtained. Herein, 12-bit data of 600 dpi×600 dpi resolution for each color is converted into data of 8 bit and 256 level gradation.

After that, in step S64, quantization processing for generating a binary image is executed on the gamma-corrected data. For example, in a case where data to be recorded which has 600 dpi×600 dpi resolution and includes 4 pixels×4 pixels is input, the quantization (gradation reduction) processing is executed on the data by an error diffusion method. Herein, the gradation is reduced to two-gradation. As a result, gradation-reduced data is generated. In addition, the quantization process may be performed on the data of 256 gradation so that the data become multivalued such as four-gradation data. In this case, the data may be further converted into binary data representing either dot formation or dot non-formation of ink by using a predetermined dot arrangement pattern according to a four-gradation level after the quantization. In such a manner, the data including binary signals C3, M3, Y3, K3, and Post3 is generated.

In step S65, expansion processing is performed only on the signal Post3, to generate data PostBolded. Through this processing, an application pattern of the post-treatment liquid is expanded. This processing is preferable because even if a recording position of color ink is misaligned with a recording position of the post-treatment liquid, the post-treatment liquid can cover the color ink. Such a configuration causes the post-treatment liquid to be applied to a portion to which color ink is applied, and to its vicinity. The vicinity of the portion to which color ink is applied is an area a several dots distant from an end of the portion where color ink is applied. If the application position of color ink is misaligned, the misalignment occurs only within a range of a several dots. With this configuration, an entire ink image formed with the color ink can be covered by the post-treatment liquid. This processing is executed in a case where the 3DLUT1 is determined in step S52, and is not executed in a case where the 3DLUT2 is determined in step S53 because the post-treatment liquid is applied to the entire surface of the intermediate transfer body. In data processing in the expansion processing, a pixel value of a copy source in which the signal Post 3 is one can be copied on peripheral pixels of a predetermined bold amount near a pixel where the signal Post3 is 1. This bold processing can be omitted if necessary. There is a case where the misalignment between the application positions of the color ink and the post-treatment liquid does not practically occur. Alternatively, if the post-treatment liquid does not have to be applied beyond a range of the color ink application due to the transfer property of the color ink itself onto a recording medium, the post-treatment liquid is applied only to a portion where the color ink is applied. The post-treatment liquid does not have to be applied to a portion which is outside the color ink and to which only the pre-treatment liquid is applied.

A second exemplary embodiment will be described below. In the first exemplary embodiment, the pre-treatment liquid has been applied to the entire surface of the intermediate transfer body. On the contrary, in the second exemplary embodiment, a pre-treatment liquid is applied selectively to a portion to which ink is applied using a recording head.

Figure 8:
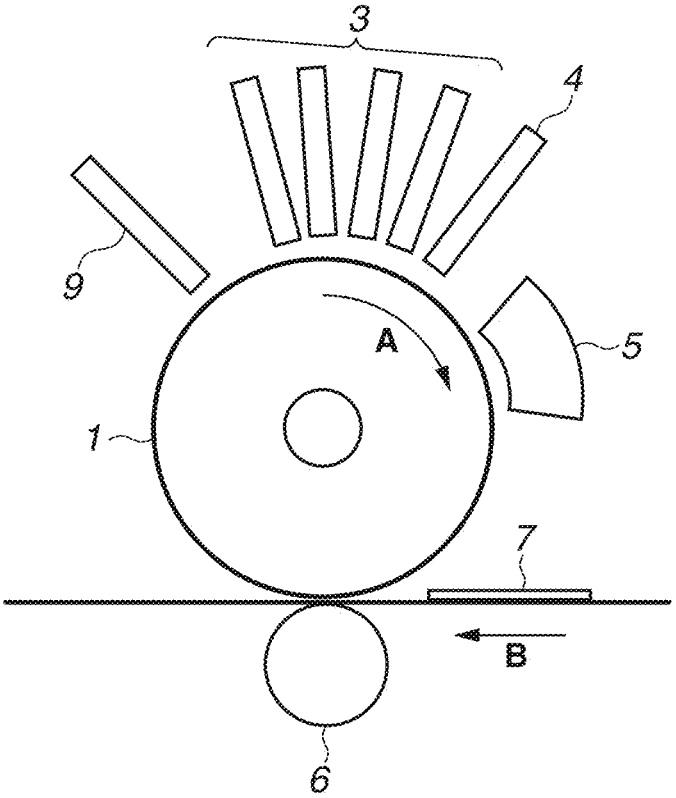
FIG. 8 is a cross-sectional view of the ink jet recording apparatus according to the exemplary embodiment.

FIG. 8 schematically illustrates a cross-sectional view for showing a configuration of an image forming unit of the ink jet recording apparatus according to the second exemplary embodiment of the present disclosure.

A point different from the ink jet recording apparatus according to the first exemplary embodiment described with reference to the FIG. 2 is that the pre-treatment liquid is applied from a recording head 9 for the pre-treatment liquid by ejecting ink from each nozzle based on pre-treatment liquid data. The other points are similar to those in the first exemplary embodiment.

A flowchart of the recording processing in the present exemplary embodiment is the same as the flowchart in the first exemplary embodiment, except that the method for applying the pre-treatment liquid which is ejected from the recording head in step S32 of the flowchart in FIG. 3.

A flowchart of recording preparation processing in the present exemplary embodiment is the same as the flowchart described in the first exemplary embodiment with reference to FIG. 4, except that the post-treatment liquid data preparation sequence in step S43 of the flow in FIG. 4 is sequences of preparation of the post-treatment liquid data and preparation of the pre-treatment liquid data.

Figure 9:
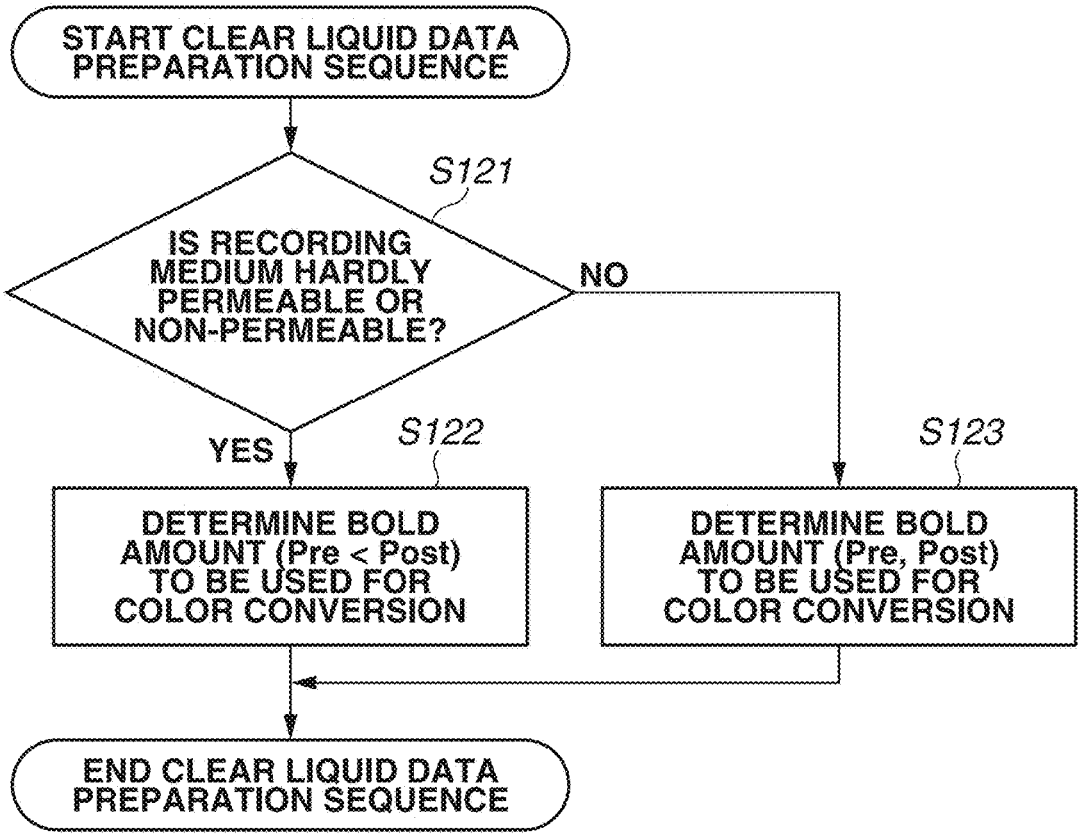
FIG. 9 is a flowchart of a part of the recording process according to the exemplary embodiment.

Each step in the preparation sequences of the pre-treatment liquid data and the post-treatment liquid data will be described with reference to FIG. 9. The preparation sequences of the two treatment liquid data are referred to here as clear liquid data preparation sequences.

When the clear liquid data preparation sequence starts, a determination is made in step S121 whether a recording medium is hardly-permeable or non-permeable for a treatment liquid. This determination is the same as step S51 in the sequence described with reference to FIG. 5 in the first exemplary embodiment.

If the determination "Yes" is made in step S121, the processing proceeds to step S122, and bold amounts for creating pre-treatment liquid data and post-treatment liquid data are determined. In the drawing, Pre<Post means that in a case where a pre-color ink pattern is a reference, a pre-treatment liquid pattern represented by pre-treatment liquid data after bolded, is wider than a post-treatment liquid pattern represented by post-treatment liquid data after bolded. In expansion processing described below, the expansion processing is executed on the quantized pre-treatment liquid data (Pre3) by a predetermined amount, and thus pre-treatment liquid data (PreBolded) is generated. With the quantized post-treatment liquid data (Post3), the expansion processing is further executed on the pre-treatment liquid data. When the color ink data is taken as a reference, the bold amount of the pre-treatment liquid<the bold amount of the post-treatment liquid.

On the other hand, in a case where the permeability of a recording medium is high, since fixability of a bold portion of the pre-treatment liquid (portion without color ink) is not a problem, the bold amount of the pre-treatment liquid does not have to be taken into consideration with respect to the bold amount in the generation of the post-treatment liquid data, and thus each parameter may be independent. Consequently, in step S123, the bold amount of the post-treatment liquid is determined to be smaller than the bold amount of the post-treatment liquid determined in step S122.

The clear liquid data preparation sequence is then ended.

Figure 10:
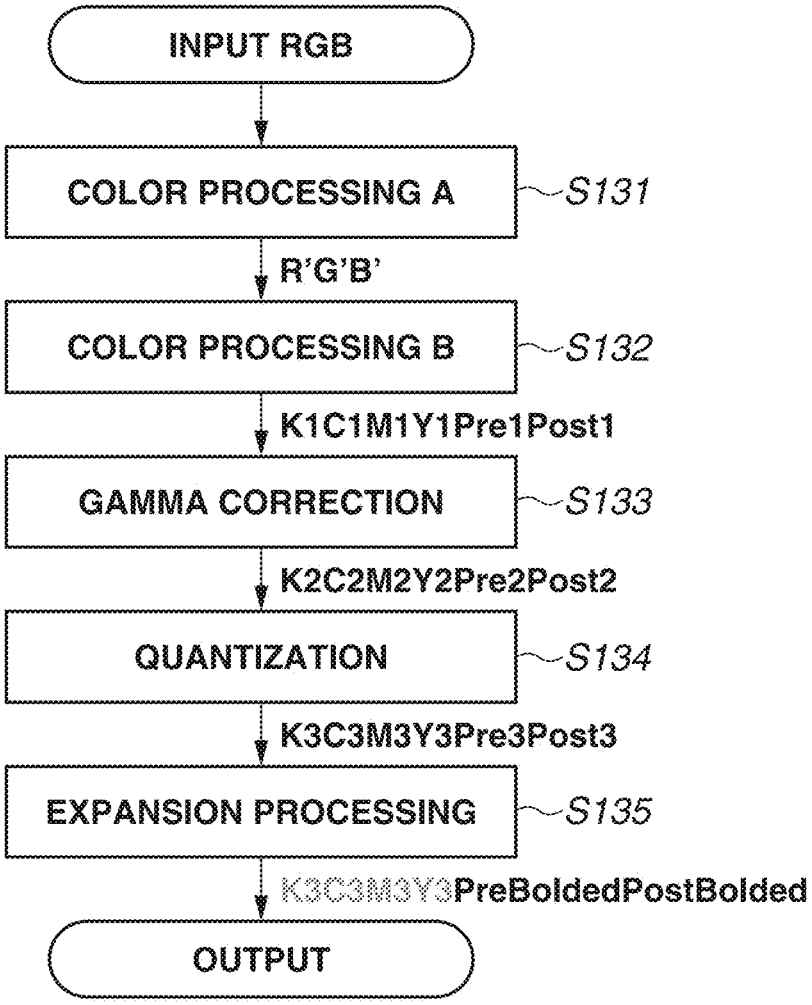
FIG. 10 is a flowchart of a part of the recording process according to the exemplary embodiment.

The color conversion processing will be described below with reference to FIG. 10. FIG. 10 is a flowchart of color processing, and each step in the color processing will be described with reference to this drawing.

Color processing A in step S131 is equal to the color processing A (FIG. 6) in step S61 in the first exemplary embodiment.

Color processing B in step S132 is then executed. Its difference from the first exemplary embodiment is that data to be generated includes not only data C1, M1, Y1, K1, and Post1 but also pre-treatment liquid data Pre1. Contents of the data Pre1correspond to the contents of data Post1, and thus a signal for applying the pre-treatment liquid data Pre1 is generated with respect to a signal for applying color ink. For example, in the 3DLUT in FIG. 7B, if data of any one of color ink is not 0, the signal value of Pre1 can be set to 128 similarly to Post1. The processing in step S133 and step S134 is similar to the processing in step S63 and step S64 (FIG. 6) in the first exemplary embodiment. The processing for the data Post1 is similarly executed on the data Pre1, and six kinds of signal data K3, C3, M3, Y3, Pre3, and Post3 are generated. At this time, patterns formed by the data Pre3 and Post3 are the same as each other.

In step S135, the expansion processing is executed on quantized data Pre3 and Post3. This expansion processing is equal to the processing in step S65 in the first exemplary embodiment. when the bold amount (Pre<Post) is determined in step S122 (FIG. 9), a pixel value of a copy source in which the signal of Pre3 is one, is copied to peripheral pixels of a predetermined bold amount which are adjacent to the pixel in which the signal of Pre3 for the pre-treatment liquid is one. The Post3 for the post-treatment liquid is bolded in the same method. However, the pixel value of the copy source in which the signal of Post3 is one is copied with a larger width of the adjacent peripheral pixels than in the case of Pre3. In such a manner, the post-treatment liquid can be applied, while covering an application area of the pre-treatment liquid, also to a wider range than the application area. Thus generated and quantized data K3, C3, M3, and Y3 of the color ink, and the data PreBolded and PostBolded subjected to the bold processing are output to be transmitted to the corresponding heads. In the present exemplary embodiment, bolded data of the post-treatment liquid is generated by executing the expansion processing on the data Post3 obtained by quantizing the post-treatment liquid data. However, the data PostBolded may be generated by executing the expansion processing on the data PreBolded obtained by executing the bold processing on the data Pre3 of the pre-treatment liquid. Also in such a manner, the post-treatment liquid can cover the range of the pre-treatment liquid. In this case, without generating the Post1 in the color processing B in step S132, the data of the post-treatment liquid is generated in the expansion processing in step S135.

Figure 11:
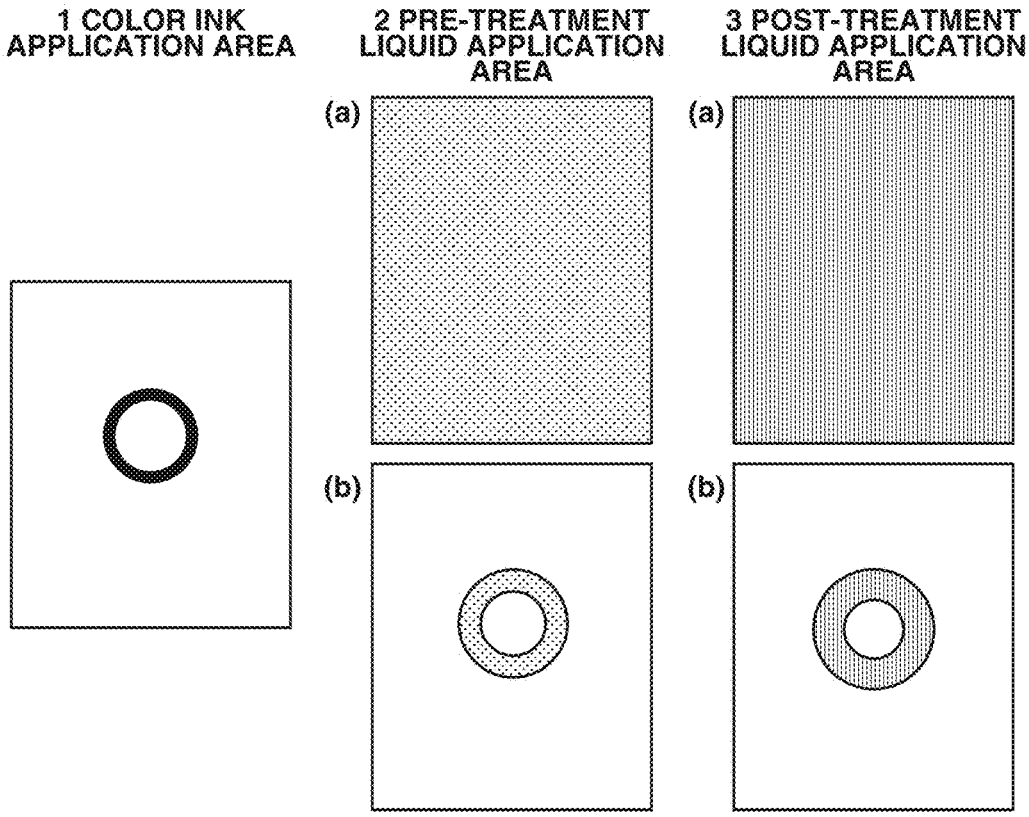
FIG. 11 shows schematic diagrams illustrating areas to which ink, a pre-treatment liquid, and a post-treatment liquid are applied, according to the exemplary embodiment.

FIG. 11 shows diagrams illustrating a correlation among the color ink application area, the pre-treatment liquid application area, and the post-treatment liquid application area in a case where non-permeable and hardly permeable recording media are used in the first exemplary embodiment and the second exemplary embodiment. Vertical directions in FIG. 11 correspond to a moving direction of the recording medium during recording (the rotational direction A of the transfer drum in the first exemplary embodiment).

In the "color ink application area" numbered 1, a black portion represents the color ink application area, and a white portion represents a state that nothing is applied. On the other hand, the pre-treatment liquid application area (a) is an entire surface of a recording medium (colored area) as shown in the first exemplary embodiment. Since the post-treatment liquid application area is equal to the pre-treatment liquid application area or a wider range including the pre-treatment liquid application area, the post-treatment liquid has to be applied to the entire surface (hatched area) ("the post-treatment liquid application area" numbered 3). On the other hand, in the second exemplary embodiment, as illustrated in the (b) of "pre-treatment liquid application area" numbered 2, the pre-treatment liquid is applied to a range extended inward and outward from a color ink printed area (area with color). Further, as illustrated in (b) of the "post-treatment liquid application area" numbered 3, the pre-treatment liquid is applied to a range widened inward and outward from the color ink printed area (hatched area).

Other Exemplary Embodiments

In the above-described first exemplary embodiment and second exemplary embodiment, the pre-treatment liquid, the ink, and the post-treatment liquid has been applied onto the intermediate transfer body, and the post-treatment liquid has been heated and transferred onto a recording medium. However, as other exemplary embodiments, the pre-treatment liquid, the ink, and the post-treatment liquid can be directly applied to a recording medium, and then the liquid-applied portion of the recording medium may be heated. The recording medium is moved along a route similar to a rotational locus of the transfer body in FIG. 1. In this case, similarly to the first exemplary embodiment, the pre-treatment liquid application unit 2, the recording head unit 3, and the post-treatment liquid application unit 4 may apply the respective liquids to the recording medium, and the liquids are absorbed and heated. Also in such a form, similarly to the first exemplary embodiment, recording depending on a type of recording medium can be performed in accordance with the flowchart described in FIG. 3 to FIG. 6.

Working examples and comparative examples will be described below. In the working examples and the comparative example, a recording medium and a method for applying a post-treatment liquid were changed, and samples were created as to a portion to which color ink was not applied to a pre-treatment liquid to make an evaluation.

Working Example 1

A sample was created under a following condition by using the ink jet recording apparatus of FIG. 1.

(Prescription of Pre-Treatment Liquid)

Following components were mixed, sufficiently agitated, filtrated with pressure through a cellulose acetate filter having 3.0 μm pores (manufactured by ADVANTEC) to prepare a reactant.

Levulinic acid: 40.0 parts

Glycerin: 5.0 parts

Megaface F-444: 1.0 part (surfactant, manufactured by DIC Corporation)

Ion-exchange water: 54.0 parts (Prescription of Post-Treatment Liquid)

<Preparation of Resin Aqueous Solution>

Styrene-acrylic acid butyl-acrylic acid copolymer (resin) in which acid value is 132 mgKOH/g, weight-average molecular weight is 7700, glass-transition temperature is 78□ was prepared. Resin of 20.0 parts was neutralized by potassium hydroxide which is equimolar to an acid value of the resin, a suitable amount of pure water was added, and a resin aqueous solution in which a content of resin (solid content) is 20.0% was prepared.

<Preparation of Post-Treatment Liquid>

Following respective components were mixed, sufficiently agitated, a cellulose acetate filter having 3.0 μm pores (manufactured by ADVANTEC) to prepare a reactant.

Water dispersion of Resin particle 1: 30.0%

Aqueous Solution of Resin 2: 3.0%

Glycerin: 5.0%

Diethylene glycol: 4.0%

Acetylenol E100: 1.0% (surfactant, manufactured Kawaken Fine Chemicals Co., Ltd.)

Ion-exchange water: 57.0%

The pre-treatment liquid was applied to the intermediate transfer body having a surface made up of silane condensate, and without providing ink, a post-treatment liquid was applied so that resolution became 16 ng/dpi. The intermediate transfer body was heated (100□), and the liquid was transferred onto cast-coated paper (Gloria Pure White (product name) manufactured by Gojyo Paper Mfg. Co., Ltd.) with transfer pressure of 10 kg/cm$^2$.

Working Example 2

A sample was created similarly to the working example 1, except that the post-treatment liquid was applied to the intermediate transfer body such that definition of the liquid became 8 ng/dpi, and gloss-coated paper (Aurora Coat (product name) manufactured by Nippon Paper Industries Co., Ltd.) was used as the recording medium in the working example 2.

Working Example 3

High-quality paper showing higher absorbency than the recording media used in the working examples 1 and 2 with respect to a reactant (OK Prince High Quality (product name) manufactured by Oji Paper Col, Ltd.) was used. A post-treatment liquid was not provided. Except for these points, a sample was created similarly to the working example 2.

Comparative Example 1

A sample was created similarly to the working example 1 except that the post-treatment liquid was not provided.

Comparative Example 2

A sample was created similarly to the working example 2 except that the post-treatment liquid was not provided.

(Evaluation)

Evaluations were made as follows: The respective samples were touched by fingers and touched portions were visually checked under an observation light source.

In the working examples 1 to 3 and the comparative example 3, a finger mark was not recognized. However, in the comparative examples 1 and 2, a finger mark was recognized.

According to the present disclosure, a printed object with hardly deteriorating quality can be obtained by using the pre-treatment liquid.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-117891, filed Jun. 15, 2017, which is hereby incorporated by reference herein in its entirety.

What is claimed is:

1. A recording apparatus comprising:

an ink application unit configured to apply ink to a transfer body to form an ink image corresponding to an image to be formed on the transfer body;

a first application unit configured to apply a first treatment liquid over an area from a portion on the transfer body to which the ink is applied, to an area outside of the ink applied portion, the first treatment liquid containing a component which acts on a component included in the ink and suppressing a movement of the ink on the transfer body through the action;

a second application unit configured to apply a clear second treatment liquid to the transfer body, the second treatment liquid including a resin which becomes a membrane by heating;

a heating unit configured to heat the second treatment liquid applied to the transfer body; and a transfer unit configured to transfer the ink image, the first treatment liquid at an area outside the ink image, and the second treatment liquid onto a recording medium, wherein in a case where the recording medium is a predetermined medium, the second application unit applies the second treatment liquid to the first treatment liquid on the area outside of the ink applied portion in a predetermined ratio, and in a case where permeability of the first treatment liquid is higher in the recording medium than in the predetermined medium, the second application unit applies the second treatment liquid to the first treatment liquid on the area outside of the ink applied portion in a ratio lower than the predetermined ratio or does not apply the second treatment liquid.

2. The recording apparatus according to claim 1, wherein the predetermined medium is cast-coated paper or vapor-deposition paper, and the recording medium which is higher than the predetermined recording medium in the permeability with respect to the first treatment liquid is, plain paper or gloss paper.

3. The recording apparatus according to claim 1, the first application unit applies the first treatment liquid over an entire area on the transfer body where the ink image is to be formed.

4. The recording apparatus according to claim 3, wherein in a case where the recording medium is the predetermined medium, the second application unit applies the second treatment liquid over an entire area on the transfer body to which the first treatment liquid is applied.

5. The recording apparatus according to claim 3, wherein in a case where the permeability of the first treatment liquid is higher in the recording medium than in the predetermined medium, the second application unit applies the second treatment liquid only to the portion on the transfer body to which the ink is applied, or only to the portion on the transfer body to which the ink is applied and a vicinity of the ink applied portion based on information representing the portion to which the ink is applied based on image data representing the image.

6. The recording apparatus according to claim 1, wherein the first application unit applies the first treatment liquid to the transfer body according to data obtained by executing bold processing on data corresponding to the ink image based on image data representing the image.

7. The recording apparatus according to claim 1, wherein after the first application unit applies the first treatment liquid to the transfer body, the ink application unit forms the ink image on the first treatment liquid on the transfer body.

8. The recording apparatus according to claim 1, further comprising:

an obtaining unit configured to obtain information about a type of the recording medium, wherein the second application unit applies the second treatment liquid to the transfer body based on the information obtained by the obtaining unit.

9. A recording method comprising:

applying ink to a transfer body to form an ink image corresponding to an image to be formed on the transfer body;

applying a first treatment liquid over an area from a portion on the transfer body to which the ink is applied, to an area outside of the ink applied portion, the first treatment liquid containing a component which acts on a component included in the ink and suppressing a movement of the ink on the transfer body through the action;

applying a clear second treatment liquid to the transfer body, the second treatment liquid including a resin which becomes a membrane by heating;

heating the second treatment liquid applied to the transfer body; and transferring the ink image, the first treatment liquid at an area outside the ink image, and the second treatment liquid to a recording medium, wherein in a case where the recording medium is a predetermined medium, the second treatment liquid is applied to the first treatment liquid on the area outside of the ink applied portion in a predetermined ratio, and in a case where permeability of the first treatment liquid is higher in the recording medium than in the predetermined medium, the second treatment liquid is applied to the first treatment liquid on the area outside of the ink applied portion in a ratio lower than the predetermined ratio, or is not applied to the first treatment liquid.

10. The recording method according to claim 9, wherein the predetermined medium is cast-coated paper or vapor-deposition paper, and the recording medium which is higher than the predetermined recording medium in the permeability with respect to the first treatment liquid is, plain paper or gloss paper.

11. The recording method according to claim 9, in the applying a first treatment liquid, the first treatment liquid is applied over an entire area on the transfer body where the ink image is to be formed.

12. The recording method according to claim 1, wherein in a case where the recording medium is the predetermined medium, the second treatment liquid is applied over an entire area on the transfer body to which the first treatment liquid is applied.

13. The recording method according to claim 11, wherein in a case where the permeability of the first treatment liquid is higher in the recording medium than in the predetermined medium, the second treatment liquid is applied only to the portion on the transfer body to which the ink is applied, or only to the portion on the transfer body to which the ink is applied and a vicinity of the ink applied portion based on information representing the portion to which the ink is applied based on image data representing the image.

14. The recording method according to claim 9, wherein the first treatment liquid is applied to the transfer body according to data obtained by executing bold processing on data corresponding to the ink image based on image data representing the image.

* * * * *